US008387417B2

(12) United States Patent
Yokoo et al.

(10) Patent No.: US 8,387,417 B2
(45) Date of Patent: Mar. 5, 2013

(54) METHOD AND APPARATUS FOR COLLECTING FIBROUS MATERIAL

(75) Inventors: Yuji Yokoo, Tokyo (JP); Susumu Kubota, Tokyo (JP); Kazuhiro Kitamura, Tokyo (JP)

(73) Assignee: Asahi Fiber Glass Company, Limited, Tokyo (JP)

( * ) Notice: Subject to any disclaimer, the term of this patent is extended or adjusted under 35 U.S.C. 154(b) by 202 days.

(21) Appl. No.: 12/918,009

(22) PCT Filed: Feb. 18, 2009

(86) PCT No.: PCT/JP2009/052805

§ 371 (c)(1),
(2), (4) Date: Aug. 18, 2010

(87) PCT Pub. No.: WO2009/104647

PCT Pub. Date: Aug. 27, 2009

(65) Prior Publication Data

US 2010/0307198 A1 Dec. 9, 2010

(30) Foreign Application Priority Data

Feb. 18, 2008 (JP) ..... 2008-036540

(51) Int. Cl.
*C03B 37/04* (2006.01)

(52) U.S. Cl. ..... 65/458; 65/505; 65/454; 65/462; 65/464; 65/469

(58) Field of Classification Search ..... 65/458, 65/505, 454, 462, 464, 469
See application file for complete search history.

(56) References Cited

U.S. PATENT DOCUMENTS

| | | | | |
|---|---|---|---|---|
| 4,061,485 | A | 12/1977 | Rimmel | |
| 4,553,996 | A * | 11/1985 | Muschelknautz et al. | 65/464 |
| 4,592,769 | A | 6/1986 | Lemaignen | |
| 2004/0083764 | A1 | 5/2004 | Butler | |

FOREIGN PATENT DOCUMENTS

| | | |
|---|---|---|
| EP | 0 072 300 A1 | 2/1983 |
| EP | 1 867 770 A1 | 12/2007 |
| JP | 58 79836 | 5/1983 |
| JP | 59 7652 | 2/1984 |
| JP | 59 199855 | 11/1984 |
| JP | 2007 332499 | 12/2007 |
| WO | 2004 041736 | 5/2004 |

OTHER PUBLICATIONS

Extended European Search Report issued May 10, 2011, in European Patent Application No. 09712502.5.

* cited by examiner

*Primary Examiner* — Queenie Dehghan
(74) *Attorney, Agent, or Firm* — Oblon, Spivak, McClelland, Maier & Neustadt, L.L.P.

(57) ABSTRACT

It is an object of the present invention to uniformly disperse fibrous material such as short glass fibers so as to be distributed on a collection conveyor, without using compressed air for dispersion of the fibrous material.

The present invention provides a method for collecting fibrous material, wherein the fibrous material fiberized by a spinner of a fiberizing unit is dispersed by a hollow bucket disposed just under the spinner, so as to be collected on a collection conveyor disposed below the hollow bucket, comprising:

forming said hollow bucket by connecting a blasting section having an oval opening at its lower end, with a waistline section as a lower end of a hopper section having a circular shape in cross section, and deforming the inner surface of the blasting section toward said oval opening, thereby dispersing the fibrous material dropped in the hollow bucket in a width direction of the collection conveyor from the blasting section, so as to be collected on the collection conveyor.

8 Claims, 3 Drawing Sheets

METHOD AND APPARATUS FOR COLLECTING FIBROUS MATERIAL

TECHNICAL FIELD

The present invention relates to a method and an apparatus for collecting fibrous material when the fibrous material is collected to produce a fibrous product for, e.g., a thermal insulation product or an acoustical insulation product. In particular, the present invention relates to a method and an apparatus for collecting short glass fibers (glass wool) such that the short glass fibers are controllably distributed in a uniform and constant thickness.

BACKGROUND ART

Inorganic fibrous products, in particular products made of glass fibers, are mainly made of continuous fibers (continuous glass fibers) or discontinuous fibers (short glass fibers). Among them, discontinuous fibers are generally used for a thermal insulation product. In this case, in order to form fiberized discontinuous fibers in a certain shape, a resin as a binder is applied to the discontinuous fibers to make the discontinuous fibers into a mat product, a plate product or a roll product, followed by partly or entirely coating or bonding e.g., a facing on such a product according to applications. These products are utilized as thermal insulation products for houses or general construction. An example of the other applications of the discontinuous fibers is an acoustical insulation product. Since finely fiberized discontinuous fibers effectively absorb a noise in the fibrous space made thereof, the finely fiberized discontinuous fibers can have an excellent advantage in noise suppression by being used in a sound insulation wall for, e.g., various buildings or roads.

In order to use discontinuous fibers to produce such a thermal insulation product or an acoustical insulation product, it is important to uniformly distribute fiberized discontinuous fibers on a collection conveyor. Heretofore, short glass fibers (hereinafter, sometimes abbreviated as "fibers") fiberized by a spinner of a fiberizing unit are dropped in a hollow bucket disposed just under the spinner, to be formed into a bundle (hereinafter, referred to as "veil") of short glass fibers, and the fibers are discharged from a circular opening of the hollow bucket into a collection zone (hereinafter, referred to as "hood") to be uniformly distributed and collected on the collection conveyor. As a method for uniformly distributing the veil discharged from the hollow bucket on the collection conveyor, the following method has been known.

(1) Patent Document 1 discloses a method of alternately blowing compressed air to the veil from both sides of the veil so as to disperse and uniformly distribute the veil on a collection conveyor (hereinafter, referred to as an air dispersion system).

(2) Patent Document 2 and Patent Document 3 disclose a method of mechanically swinging the veil in a direction at right angles to the flow direction of a collection conveyor to disperse and uniformly distribute the veil on the collection conveyor (hereinafter, referred to as "a mechanical system").

The above air dispersion system uses compressed air to uniformly distribute short glass fibers in a width direction of a collection conveyor. That is, as shown in FIG. 6, fibers fiberized by a spinner 1 of a fiberizing unit, after the veil 5 discharged from the hollow bucket 2 is sprayed with a binder by a binder applicator 12, flow down in a hood 11 while they are swung in a width direction of a collection conveyor and dispersed by blowing compressed air from both sides from an air blowing unit 18, so as to be uniformly collected on the collection conveyor 8 as a mat of fibers 7. Further, the compressed air blown is sucked through the collection conveyor 8 and is discharged and treated as an exhaust gas 9.

In the above method, fibers are likely to be stirred up in the hood since a large amount of compressed air is employed to disperse the fibers. The stirring up of fibers is a phenomenon showing the presence of agglomerated fibers floating in the space in the hood without being collected on the conveyor, when the fibers are collected on the conveyor. Since the above binder applied on the fibers is viscous and adhesive, fibers are likely to be agglomerated to form clusters of fibers in the space in the hood, or deposited on the fiberizing unit or equipments in the hood to form clusters of fibers, under a condition where fibers are greatly stirred up. As the clusters of fibers are getting larger in size, these clusters are likely to be dropped on the collected mat of fibers, whereby the quality of a product tends to be deteriorated, such being problematic.

Heretofore, in order to prevent clusters of fibers from being formed, it is required to periodically clean the inside of the hood, and in order to restrain fibers from being stirred up, it is required to make the fiber collecting apparatus larger. However, when the fiber collecting apparatus is made larger, the amount of exhaust gas increases, and huge energy is needed to clean up the exhaust gas. Although an attempt is made to increase the suction amount of the collection conveyor in order to restrain the stirring-up of fibers, huge energy is also needed since electric energy for a fan to be used for suction increases.

On the other hand, in the mechanical system, a hollow bucket is disposed under a fiberizing unit, and the bucket is swung in a direction (width direction) at right angles to the conveying direction of the collection conveyor, whereby short glass fibers dropped in the bucket are dispersed and collected on the collection conveyor. However, such a method had a problem that the frequency of mechanical failure increases since load to a mechanical moving part is increased as the bucket is swung for dispersing the short glass fibers. Further, there is a case where dispersibility is poor since the short glass fibers were dispersed merely by swinging the bucket.

Patent Document 1: JP-B-59-7652
Patent Document 2: JP-A-59-199855
Patent Document 3: WO2004/041736

DISCLOSURE OF THE INVENTION

Objects to be Accomplished by the Invention

It is an object of the present invention to provide a collection method capable of uniformly distributing fiberized fibrous material on a collection conveyor, without using compressed air and without mounting a swinging apparatus on a bucket, and a collection apparatus therefor.

Means to Accomplish the Object

In order to accomplish the above object, the present inventors have conducted studies on a method for collecting fiberized fibrous material, and as a result, they have found that by deforming the shape of a blasting section for discharging fibers in a hollow bucket disposed under a spinner, it is possible to uniformly disperse the fibrous material and collect it on a collection conveyor, without blowing compressed air and without swinging a hollow bucket, and the present invention has been accomplished on the basis of this discovery.

The present invention provides a method (hereinafter, referred to as "a collection method of the present invention") for collecting fibrous material, wherein the fibrous material fiberized by a spinner of a fiberizing unit is dispersed by a hollow bucket disposed just under the spinner, so as to be collected on a collection conveyor disposed below the hollow bucket, comprising:

forming said hollow bucket by connecting a blasting section having an oval opening at its lower end, with a waistline section as a lower end of a hopper section having a circular shape in cross section, and deforming the inner surface of the blasting section toward said oval opening, thereby dispersing the fibrous material dropped in the hollow bucket in a width direction of the collection conveyor from the blasting section, so as to be collected on the collection conveyor.

In the collection method of the present invention, the above fibrous material is preferably short glass fibers.

Further, the present invention provides an apparatus (hereinafter, referred to as "a collection apparatus of the present invention") for collecting fibrous material, wherein the fibrous material fiberized by a spinner of a fiberizing unit is dispersed by a hollow bucket disposed just under the spinner, so as to be collected on a collection conveyor disposed below the hollow bucket, wherein said hollow bucket has a hopper section having a circular shape in cross section and a blasting section having an oval opening at its lower end, which is connected with a waistline section as a lower end of the hopper section, the inner surface of the blasting section is deformed from a circular shape toward the oval opening, and the fibrous material dropped in the hollow bucket is dispersed from the blasting section in a width direction of the collection conveyor, so as to be collected on the collection conveyor.

In the collection apparatus of the present invention, it is preferred that the inner surface in the long axis direction of the oval opening of said blasting section is inclined outwardly toward the oval opening, at an inclination angle of 5 to 45° to the center axis of the hollow bucket.

Further, in the collection apparatus of the present invention, it is preferred that the area of the waistline section of said hopper section is the same as or larger than the area of the oval opening of the blasting section, and further it is preferred that the area of the waistline section of said hopper section is the same as or larger than the area of the cross section of the spinner. Further, it is preferred that the ratio of long diameter/short diameter of the oval opening of said blasting section is from 1.4/1 to 6/1.

Effects of the Invention

According to the present invention, as mentioned above, the opening at a lower end of a blasting section of a hollow bucket is formed into an oval shape, whereby it is possible to discharge fiberized fibrous material from the oval opening so as to be spread over in a width direction of a collection conveyor, and it is thereby possible to uniformly distribute and collect the fibrous material on the collection conveyor. Further, since no compressed air is used for controllably distributing the fibrous material unlike the conventional methods and apparatuses, it is not necessary to employ facilities for compressed air, and it is possible to decrease the amount of an exhaust gas in the apparatus for collecting the fibrous material. Thus, it is possible to reduce the costs required for the facility for dealing with the exhaust gas and the process for cleaning up the exhaust gas. Furthermore, remodeling of a part (hollow bucket) of existing facilities is only required, and therefore installation cost can be reduced.

Further, it is possible to extremely reduce stirring up of fibers due to compressed air in the hood, and it is thereby possible to extremely reduce forming of clusters of fibers due to stirring up and forming of clusters of fibers deposited on the hood. Accordingly, inclusion of the above clusters of fibers in the fibrous material to be collected can be prevented, and therefore It is possible to obtain a high quality product and operate the collection apparatus continuously for a long time, whereby the productivity will be improved.

MEANINGS OF SYMBOLS

1: Fiberizing Unit (Spinner)
2: Hollow Bucket
3: Hopper Section
4: Blasting Section
5: Waistline Section
6: Trajectory of Fiber Flows
7: Mat of Fibers
8: Collection Conveyor
9: Exhaust Gas
10: Exhaust Gas Collection Box
11: Collection Zone (Hood)
12: Binder Applicator
13: Mounting Member
14: Bolt Hole
15: Waistline Shape
16: Opening Shape
17: Air Nozzle
18: Air Blasting Unit

BEST MODE FOR CARRYING OUT THE INVENTION

In the present invention, the fibrous material to be distributed mainly comprises inorganic fibers, which are useful as a thermal insulation product or an acoustical insulation product, specifically inorganic fibers having excellent heat resistance and excellent weatherability, such as short glass fibers (glass wool) and mineral fibers (rock wool, slag wool). Among them, the present invention is favorably applicable to short glass fibers, which can be produced at a low cost and have an excellent heat insulation performance. Various kinds of glass wool products, such as a mat product, a plate product or a roll product, can be made of such short glass fibers by using a known producing and processing method.

The above-mentioned fibrous material is fiberized by the spinner of a fiberizing unit. The present invention is characterized in that the fibrous material thus fiberized is uniformly dispersed by shaping a blasting section of a hollow bucket into oval opening without substantially using compressed air for uniformly distributing such fiberized fibrous material on a collection conveyor.

Figure 1:
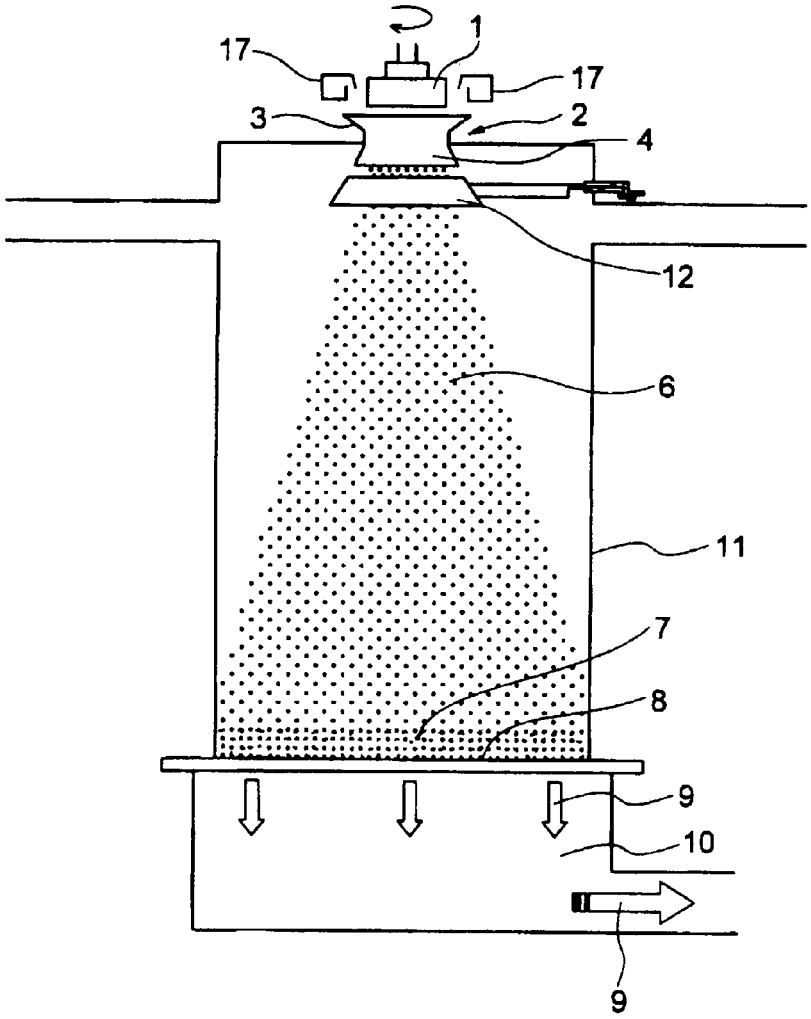
FIG. 1 is a schematic cross-sectional view illustrating the apparatus for collecting short glass fibers according to a preferred embodiment of the present invention.

Now, the present invention will be specifically described based on the accompanying drawings. The figures that will be described below show an example of the apparatus for collecting short glass fibers as a preferred embodiment of the present invention. The present invention is not limited to this example. FIG. 1 is a schematic cross-sectional view illustrating the entire apparatus about the process from fiberization to collection of short glass fibers. As shown in FIG. 1, glass discharged from a spinner 1 of a fiberizing unit is extended by a combustion gas (not shown) of the fiberizing unit and compressed air ejected from air nozzles 17 to form short glass fibers, which are dropped in a hopper section 3 of a hollow bucket 2 disposed just under the spinner 1. Then, the short glass fibers dropped in the hopper section 3 of the hollow bucket 2 are discharged from the oval opening of a blasting section 4 of the hollow bucket 2, being dispersed in a width direction of a collection conveyor, then flow down in a hood 11 and are collected on the collection conveyor 8 disposed under the hood 11 so as to be formed into a mat of fibers 7. At that time, the fibers flow down while they uniformly spread in the width direction in a trajectory as indicated by reference numeral 6, and the width of the veil is almost equal to the width of the collection conveyor 8 when the fibers reach the collection conveyor 8. In the above, on the short glass fibers dispersed in the hollow bucket 2, an aqueous solution containing a precursor for a thermosetting resin such as a phenol-formaldehyde resin is splayed and applied as a binder, from a binder applicator 12 mounted under the hollow bucket 2.

The collection conveyor 8 is disposed in the proximity of the lower end of the hood 11 under the spinner 1 and is driven at a constant speed in a direction perpendicular to the drawing sheet. The collection conveyor 8 has an air-permeable structure and has a lower portion provided with an exhaust gas collection box 10 so that a gas, such as combustion exhaust gas or air, in the hood 11 is sucked through the mat of fibers 7 and is discharged as an exhaust gas 9. Although the discharged exhaust gas 9 is cleaned up, the amount of the exhaust gas for cleaning treatment is smaller than before since the short glass fibers have not been dispersed by compressed air as in conventional distribution methods and apparatuses.

The above-mentioned process is substantially the same as commonly implemented techniques for producing glass wool or a glass wool mat except that short glass fibers are dispersed by the hollow bucket 2. For this reason, a conventional technique or apparatus may be properly used except for the hollow bucket 2. For example, the spinner 1 may be disposed at a single location or at each of plural locations along the conveying direction of the collection conveyor 8. In other words, in, e.g., a case where it is necessary to increase the thickness of the mat of fibers 7, a case where it is necessary to equalize the quality by laminating multilayered pieces of short glass fibers, or a case where it is necessary to laminate pieces of short glass fibers having different fiber diameters or different physical properties, the mat of fibers 7 can be formed in a desired structure by disposing, e.g., two to ten spinners above the collection conveyor 7 along the conveying direction so as to comply with a desired purpose and by sequentially laminating pieces of short glass fibers fiberized by the spinners onto the collection conveyor 8 advancing at a constant speed from the upstream spinner and its subsequent downstream spinners in this order. It should be noted that the basic techniques for fiberization by a spinner and collection of dispersed fibrous material with respect to such a mat of fibers are also substantially applicable to other inorganic fibers.

Figure 2:
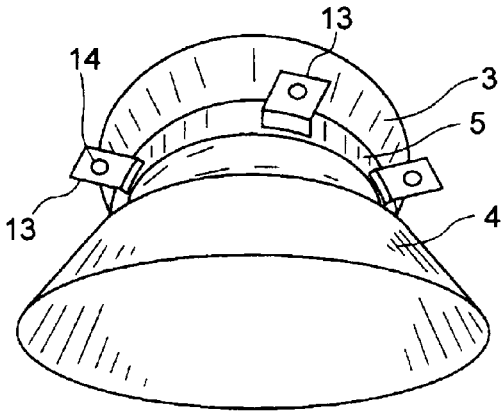
FIG. 2 is a perspective view illustrating a hollow bucket as shown in FIG. 1 observed from below.
Figure 3:
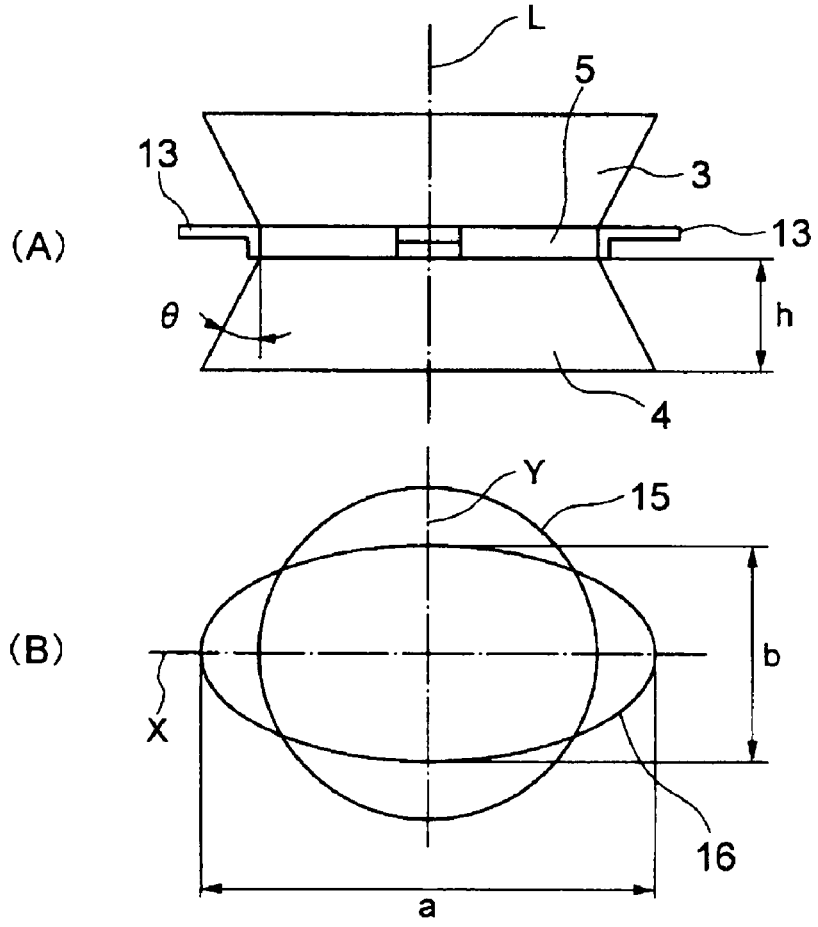
FIG. 3 (A) is a schematic front view illustrating a hollow bucket, and FIG. 3 (B) is a view illustrating a cross-sectional shape of its waistline section and a shape of its opening at a lower end.
Figure 4:
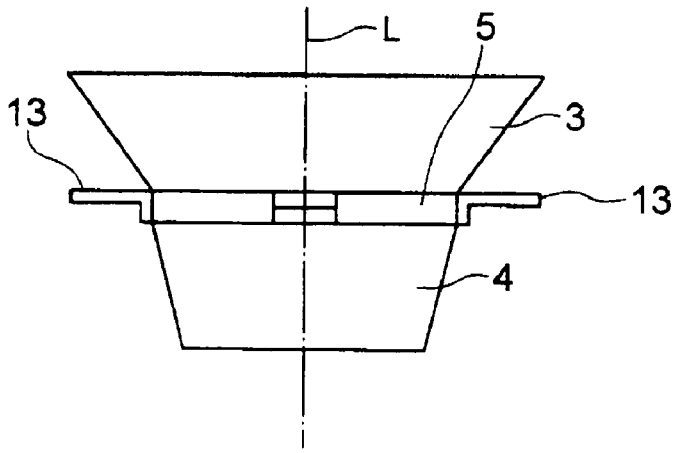
FIG. 4 is a view illustrating the right side of a hollow bucket as shown in FIG. 3 (A).

Next, one embodiment of the hollow bucket 2 will be explained. FIG. 2 is a perspective view illustrating a hollow bucket 2 as shown in FIG. 1 observed from obliquely below in a conveying direction of the collection conveyor. As shown in FIGS. 2 to 4, a plurality of (four in this embodiment) mounting members 13 each having a bolt hole 14 are mounted on the periphery of a waistline section 5 of the hollow bucket 2, and the mounting members 13 are screwed on a supporting structure (not shown), whereby the hollow bucket 2 is disposed just under the spinner.

FIG. 3 (A) is a schematic front view illustrating the above hollow bucket 2. As shown in the figure, the hollow bucket 2 in this embodiment is e.g. a hollow body made of a steel plate, having an upper end and a lower end opened, which comprises a hopper section 3 constituting an upper-stage section and a blasting section 4 constituting a lower-stage section, such hopper section 3 and blasting section 4 being connected via the waistline section 5. The hopper section 3 has a circular shape in cross section at a portion where short glass fibers fiberized by the spinner are received in the hollow bucket 2, and preferably has a funnel shape having an opening expanding toward the upper end section so as to easily receive the short glass fibers. However, the hopper section 3 may have a cylindrical shape. The waistline section 5 as a lower end of the hopper section 3 has a circular inner shape, and has a diameter equal to the diameter of the lower end of the hopper section 3. Accordingly, in the case of the hopper section 3 having a funnel shape as in this embodiment, the waistline section 5 corresponds to the minimum diameter portion of the hopper section 3. In this embodiment, the waistline section 5 is formed into a cylindrical shape with a height of from 1 to 5 cm for example, but the blasting section 4 may be connected with the lower end of the hopper section 3 without disposing such a cylindrical waistline section. In such a case, the waistline section corresponds to the lower end of the hopper section 3.

In the present invention, the blasting section 4 of the hollow bucket 2 has a specific shape. That is, the blasting section 4 has a circular shape at its upper end connected with the waistline section 5, but has an oval shape opening (hereinafter, referred to as "oval opening") at its lower end for discharging short glass fibers, and has such a specific shape that the shape is smoothly and continuously deformed from the upper end having a circular shape connected with the waistline section 5 toward the oval opening. Conventional hollow buckets to be used for an apparatus for collecting short glass fibers are cylindrical hollow bodies regardless of distribution methods, and the lower end opening for discharging the short glass fibers also has a circular shape. Accordingly, the shape of the blasting section 4 in the hollow bucket of the present invention is entirely different from conventional ones particularly in the shape of the lower end opening.

Now, the shape of the hollow bucket 2 will be described in detail with reference to the drawings. Here, in the drawings and the following descriptions, the shape of the hollow bucket 2 means the shape of the inner surface unless otherwise specified. Usually, the shape of the external surface and the shape of the inner surface of the hollow bucket 2 are substantially the same, but they are not restricted thereto.

In the FIG. 3(B), the reference numeral 15 represents the cross-sectional shape of the waistline section 5 of the hollow bucket 2, that is the shape of the upper end of the blasting section 4, and the reference numeral 16 represents the shape of the lower end opening (oval opening) of the blasting section 4. Further, FIG. 4 is a side view of FIG. 3(A). As is evident from these figures, the shape 15 of the waistline section of the hollow bucket 2 is a circular shape, but the shape 16 of the lower end opening of the blasting section 4 is an oval shape having a long axis X in a width direction of a collection conveyor. That is, in the blasting section 4 of the hollow bucket 2, as shown in FIG. 3(A), the inner surface in the long axis direction of the oval opening expands wide (outwardly) toward the oval opening so that it is inclined at an angle of θ to the center axis L of the hollow bucket 2, and on the other hand, as shown in FIG. 4, the inner surface in the short axis direction of the oval opening narrows toward the oval opening from the circular-shape waistline section 5.

In the hollow bucket of the present invention, the above angle θ is preferably from 5 to 45°, more preferably from 10 to 30°. If θ is smaller than 5°, no sufficient dispersion width of the short glass fibers can be obtained, whereby it tends to be difficult to uniformly collect the short glass fibers on the collection conveyor. Further, if θ is larger than 45°, the dispersion width of the short glass fibers discharged from the blasting section 4 will be too wide relative to the width of the collection conveyor, whereby the short glass fibers tend to be ununiformly collected on the edge portion of the collection conveyor or attached on the inner wall of the hood, such being undesirable. In practice, by taking the width of the collection conveyor, the height from the lower end of the blasting section 4 of the hollow bucket to the collection conveyor and the height h of the blasting section 4 into consideration, θ is selected within the above range. In such a case, in order to efficiently, uniformly and stably disperse the short glass fibers, an effective height h of the blasting section 4 is preferably about 100 to 1,000 mm. In the case of a blasting section having a height h shorter than 100 mm, it will be difficult to form the circular shape to a preferred oval shape toward the lower end opening since abrupt deformation is forced. On the other hand, even when the height h is higher than 1,000 mm, no further effect of stabilizing the flow of the veil will be obtained, and the effect of dispersing the short glass fibers is almost the same, and such merely leads to large sizing of the hollow bucket.

In the present invention, the dispersibility of the short glass fibers discharged from the blasting section of the hollow bucket is highly susceptible especially to the shape of the oval opening. Typically, the distribution width of the discharged short glass fibers varies considerably depending upon whether the shape of the oval opening is oval close to a circular shape with a low ratio of a long axis X to a short axis Y or elongated oval with a high ratio thereof. From such a viewpoint, the oval opening of the blasting section 4 in the hollow bucket 2 is preferred to have a ratio of the length a (long diameter) of the long axis X to the length b (short diameter) of the short axis Y within a specific range. Specifically, the long diameter/short diameter (a/b) is preferably from 1.4/1 to 6/1, more preferably from 1.5/1 to 3/1. When a/b is within such a range, it is possible to discharge the short glass fibers while widely expanding them in a long axis direction from the oval opening of the blasting section 4, thereby to substantially uniformly distribute them.

In such a case, it is preferred that the blasting section 4 of the hollow bucket is gradually deformed from a circular shape at a part connected with the hopper section 3 toward the oval opening having a/b within the above range. If the blasting section 4 is abruptly deformed in the height direction, smooth flow of the short glass fibers is inhibited since steps are formed in the blasting section. Accordingly, the dispersibility tends to be deteriorated thereby to form clusters of the short glass fibers. Further, the shape of the oval opening may not be precisely geometrically oval so long as it is oval as a whole since its purpose is to adjust the veil of the short glass fibers.

In the present invention, the diameter of the waistline section 5 of the hollow bucket 2 is preferably at least 100%, more preferably at least 110% of the diameter of the spinner 1. If the diameter of the waistline section 5 is smaller than the diameter of the spinner 1, some of the short glass fibers fiberized by the spinner 1 and dropped into the hopper section 3 of the hollow bucket 2 are likely to collide with the waistline section 5 or the lower end portion of the hopper section 3, and therefore it is difficult to smoothly supply the above short glass fibers to the blasting section 4 without clustering. On the other hand, if the diameter of the waistline section 5 is too large, the dispersion effect of the short glass fibers tends to be deteriorated. Accordingly the diameter of the waistline section 5 of the hollow bucket 2 is preferably approximately at most 150% of the diameter of the spinner 1. Thus, in the present invention, the area of the waistline section of the hopper section 2 is preferably the same as or larger than the area of the cross section of the spinner 1.

Further, the cross sectional area of the waistline section 5 of the above hollow bucket 2 is preferably the same as or larger than the area of the oval opening of the blasting section 4. This is because it is difficult to uniformly discharge short glass fibers without clustering if the cross-sectional area of the waistline section 5 is smaller than the area of the oval opening of the blasting section 4. When the cross-sectional area of the waistline section 5 is the same as or larger than the area of the oval opening of the blasting section 4, it is possible to lead the short glass fibers dropped in the hollow bucket, from the waistline section 5 to the oval opening while flowing them through the blasting section 4 under the conditions where the density of the short glass fibers is maintained to be substantially the same, so as to uniformly discharge them from the entire oval opening, and therefore it is possible to uniformly discharge the short glass fibers without clustering.

In the present invention, the area of the oval opening of the blasting section 4 to the area of the waistline section 5 can readily be adjusted by changing the height h, the angle θ and a/b of the oval opening, of the blasting section 4. For example, a hollow bucket of which the waistline section 5 of the hopper section 3 and the oval opening of the blasting section 4 have substantially the same area, is obtained in such a manner that the length of the long axis of the oval opening is calculated by determining the angle θ of the blasting section so as to conform to the width of the collection conveyor, and the length of the short axis is determined based on the length of the long axis so that the area of the oval opening is equal to the area of the waistline section. In the present invention, the area of the waistline section 5 in the hopper section 3 and the area of the oval opening in the blasting section 4 may be the same or different so long as the object of the present invention can be achieved.

In the present invention, it is preferred for the following reason that the hollow bucket 2 and the spinner 1 be spaced from each other by a predetermined distance. As shown in FIG. 1, the spinner 1 fiberizes molten glass in such a way that the molten glass, which has been projected from orifices in a lateral portion of the spinner 1 by a centrifugal force caused by fast rotation of the spinner 1, is blown off to be attenuated by compressed air ejected from an air nozzle 17. Accordingly, unless the spinner 1 and the hollow bucket 2 are distant (spaced) from each other by at least a certain distance, it is difficult to introduce the combustion gas and external air other than the compressed air from the air nozzle 17, which are necessary for uniformly stabilizing the flow of a veil of fiberized short glass fibers. As a result, there is a possibility that the quality of the short glass fibers is lowered. From this point of view, the position just under the spinner 1 in the present invention means an area positioned under and spaced from the spinner 1.

The hollow bucket 2 and the spinner 1 preferably have a ring disposed therebetween in order to stabilize air flows in the fiberizing unit and its periphery and to prevent the fiberized short glass fibers from being scattered, although not shown. As the ring, it is preferred to use a metal ring having a heat resistance, and its diameter is set to be substantially equal to the diameter of the top end of the hollow bucket 2.

Figure 5:
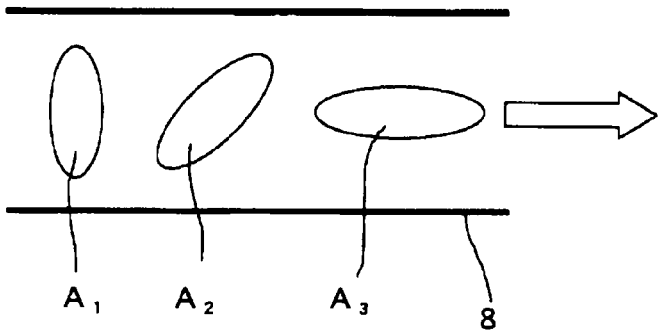
FIG. 5 is a view illustrating a disposition of a hollow bucket relative to a collection conveyor.
Figure 6:
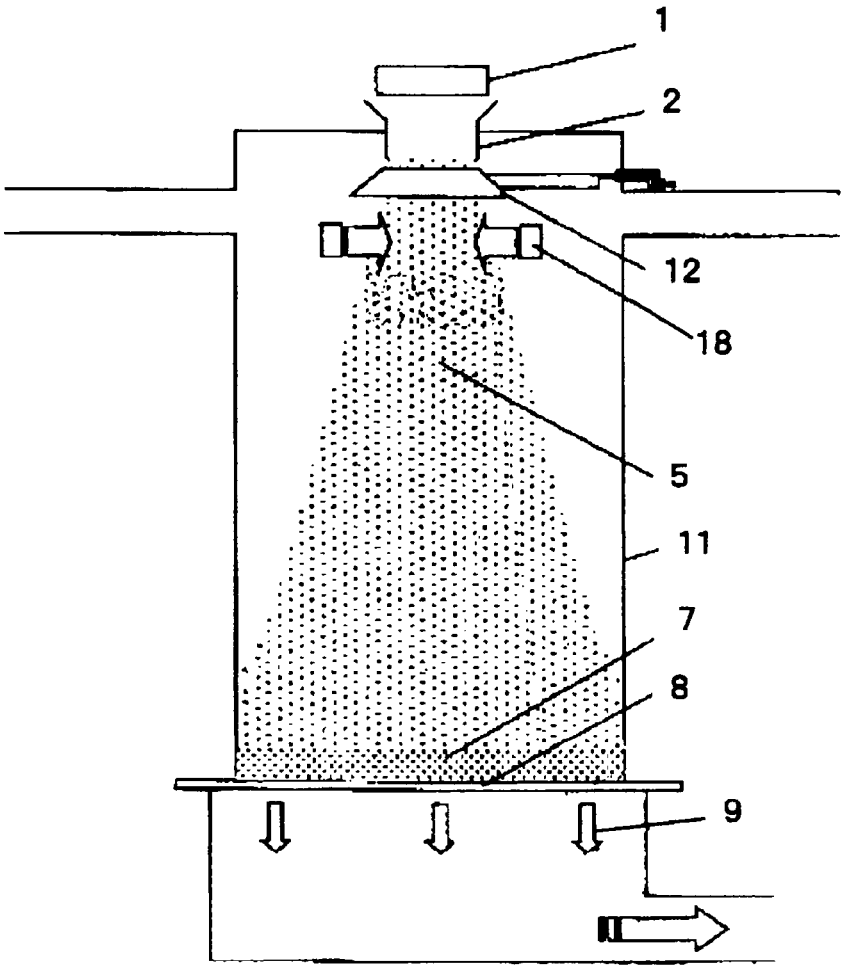
FIG. 6 is a schematic cross-sectional view illustrating a conventional apparatus for collecting short glass fibers.

Further, as shown in FIG. 5, the direction of the position of the hollow bucket 2 to the collection conveyor 8 may properly be changed. In FIG. 5, the arrow shows a moving direction of the collection conveyor 8. The hollow bucket 2 is usually positioned so that the long axis of the oval opening is parallel to the width direction of the collection conveyor 8 as shown in $A_1$, but the direction of the long axis may be inclined against the width direction of the collection conveyor 8, and it is possible to properly adjust the inclination angle depending upon the dispersion conditions of the fibers and the product width of a mat of fibers obtainable. For example, in FIG. 5, $A_2$ is a case where the direction of the long axis is inclined at 45°, and $A_3$ is a case where the direction is inclined at 90°, to the width direction of the collection conveyor 8. By changing the direction of the hollow bucket in such a manner, it is possible to easily change the dispersion width of the fibers. Further, also in the case of disposing a plurality of the fiberizing units, hollow buckets can be disposed by adjusting the directions of the long axes of the hollow buckets in the respective fiberizing units individually depending upon the dispersion conditions of the fibers and the product width of the mat of fibers obtainable.

EXAMPLES

Just under a spinner of a conventional unit for producing short glass fibers, a hollow bucket having a shape as shown in FIG. 3 was disposed so that the long axis of an oval opening of a blasting section was in the same direction as the width direction of a collection conveyor 8, short glass fibers fiberized by the spinner were dropped in a hopper section of the hollow bucket, and the short glass fibers were discharged from the hollow bucket while they were dispersed in the width direction (long axis direction) at the oval opening of the blasting section, and distributed and collected on the collection conveyor (width: 200 cm) disposed about 300 cm below the hollow bucket to produce a mat of short glass fibers (glass wool mat). The specification of the hollow bucket used is as follows.

(Hollow Bucket)

Height of hollow bucket: 450 mm

Waistline section: (inner diameter) 370 mm, (area) 107, 521 $mm^2$

Blasting section: Height (h): 300 mm

Angle θ: 20°

Long diameter (a): 234 mm, Short diameter (b): 146 mm, a/b: 1.6/1

Area: 107, 520 $mm^2$

The mat of short glass fibers produced was observed, whereupon the short glass fibers were found to be uniformly distributed in the width direction, and further, no clusters of the fibers were included. Therefore, it is found that a mat of short glass fibers having quality equal to the mat of short glass fibers obtained by conventional air dispersion method, can be obtained without controllable distribution by compression air.

Further, the amount of air (the amount of exhaust gas) sucked and treated through the collection conveyor in the collection apparatus in this Example can be reduced by 500 $m^3$/hr, as compared with a case of collecting fibers by means of a conventional air dispersion system where instead of the hollow bucket, an air blasting unit was disposed just under the spinner of the above unit for producing short glass fibers, compressed air was blown to the veil alternately from both sides of the veil so that the veil is dispersed and collected on the collection conveyor, and therefore it is possible to remarkably reduce the costs required for the facility for dealing with the exhaust gas and cleaning up of the exhaust gas.

INDUSTRIAL APPLICABILITY

The present invention is applicable to collect fibrous material to produce a fibrous product for, e.g., a thermal insulation product or an acoustical insulation product. The present invention is particularly effective to collect short glass fibers (glass wool) in such a way that the short glass fibers are controllably distributed in a uniform and constant thickness.

The entire disclosure of Japanese Patent Application No. 2008-36540 filed on Feb. 18, 2008 including specification, claims, drawings and summary is incorporated herein by reference in its entirety.

The invention claimed is:

1. An apparatus for collecting fibrous material, said apparatus comprising a fiberizing unit, a hollow bucket and a collection conveyor, wherein the fibrous material fiberized by a spinner of the fiberizing unit is dispersed by the hollow bucket disposed just under the spinner, so as to be collected on the collection conveyor disposed below the hollow bucket, and wherein said hollow bucket comprises:

a hopper section having a circular shape in cross section at an uppermost portion where the fibrous material fiberized by the spinner is received in the hopper section, and a blasting section having an oval opening at its lower end, wherein the blasting section is connected with a waistline section as a lower end of the hopper section, the inner surface of the blasting section is deformed from a circular shape toward the oval opening, and the fibrous material dropped in the hollow bucket is dispersed from the blasting section in a width direction of the collection conveyor, so as to be collected on the collection conveyor.

2. The apparatus for collecting fibrous material according to claim 1, wherein the inner surface in the long axis direction of the oval opening of said blasting section is inclined outwardly toward the oval opening, at an inclination angle of 5 to 45° to the center axis of the hollow bucket.

3. The apparatus for collecting fibrous material according to claim 1, wherein the area of the waistline section of said hopper section is the same as or larger than the area of the oval opening of the blasting section.

4. The apparatus for collecting fibrous material according to claim 1, wherein the area of the waistline section of said hopper section is the same as or larger than the area of the cross section of the spinner.

5. The apparatus for collecting fibrous material according to claim 1, wherein the ratio of long diameter/short diameter of the oval opening of said blasting section is from 1.4/1 to 6/1.

6. The apparatus for collecting fibrous material according to claim 1, wherein the hopper section has a funnel shape having an opening expanding toward the uppermost portion.

7. The apparatus for collecting fibrous material according to claim 1, wherein the hopper section has a cylindrical shape.

8. The apparatus for collecting fibrous material according to claim 1, wherein the waistline section has a circular inner shape.

* * * * *